US009764172B2

(12) United States Patent
Wolner et al.

(10) Patent No.: US 9,764,172 B2
(45) Date of Patent: Sep. 19, 2017

(54) SAFETY DEVICE WITH FALL ARREST AND DESCENDING MODES

(75) Inventors: J. Thomas Wolner, Red Wing, MN (US); Scott C. Casebolt, St. Paul Park, MN (US); Gabriel Grant Gamache, Cottage Grove, MN (US); Matthew J. Blackford, Hastings, MN (US)

(73) Assignee: D B Industries, LLC, Red Wing, MN (US)

( * ) Notice: Subject to any disclaimer, the term of this patent is extended or adjusted under 35 U.S.C. 154(b) by 2491 days.

(21) Appl. No.: 12/400,208

(22) Filed: Mar. 9, 2009

(65) Prior Publication Data

US 2010/0226748 A1 Sep. 9, 2010

(51) Int. Cl.
*A62B 35/00* (2006.01)

(52) U.S. Cl.
CPC ..... *A62B 35/0093* (2013.01)

(58) Field of Classification Search
USPC ... 182/231, 232, 234, 236, 237, 239, 71–73; 188/180, 184, 185, 188
See application file for complete search history.

(56) References Cited

U.S. PATENT DOCUMENTS

| | | | | |
|---|---|---|---|---|
| 157,660 | A | 12/1874 | Weston | |
| 523,874 | A | 7/1894 | Weston | |
| 659,093 | A | 10/1900 | Ockers | |
| 1,020,065 | A * | 3/1912 | welsh | B66D 1/36 182/236 |
| 1,363,749 | A | 12/1920 | Peterson | |
| 1,724,713 | A | 8/1929 | Johnston | |
| 1,950,289 | A | 3/1934 | Benson | |
| 2,502,896 | A | 4/1950 | Sherbrook et al. | |

(Continued)

FOREIGN PATENT DOCUMENTS

| | | |
|---|---|---|
| CH | 364180 | 9/1958 |
| DE | 177841 | 3/1905 |

(Continued)

OTHER PUBLICATIONS

Photographs of fall arrest block device, International Safety Components Ltd., Bangor, Gwynedd, United Kingdom, 11 pages (known of prior to filing of U.S. Appl. No. 12/400,208).

(Continued)

*Primary Examiner* — Katherine Mitchell
*Assistant Examiner* — Candace L Bradford
(74) *Attorney, Agent, or Firm* — Dicke, Billig & Czaja, PLLC

(57) ABSTRACT

A safety device with fall arrest and descending modes includes a housing, a drum, a lifeline, first and second brake assemblies, and a control. The drum is rotatably operatively connected to the housing. The lifeline has an intermediate portion interconnecting a first end and a second end. The first end is operatively connected to the drum. The first and second assemblies are operatively connected to the drum. The control is operatively connected to the first and second brake assemblies and has a first position and a second position. The first position selectively engages the first brake assembly in a descending mode and the second position selectively engages the second brake assembly in a fall arrest mode.

15 Claims, 11 Drawing Sheets

(56) References Cited

U.S. PATENT DOCUMENTS

| | | | | | |
|---|---|---|---|---|---|
| 2,680,593 | A * | 6/1954 | McIntyre | A62B 1/10 | 182/231 |
| 2,776,815 | A | 1/1957 | Sheard | | |
| 2,809,804 | A | 10/1957 | Sheard | | |
| 3,081,839 | A | 3/1963 | O'Brien | | |
| 3,089,599 | A | 5/1963 | Casella | | |
| 3,101,927 | A | 8/1963 | Gray | | |
| 3,204,720 | A | 9/1965 | Eitel | | |
| 3,946,989 | A * | 3/1976 | Tsuda | A62B 1/10 | 182/241 |
| 3,999,627 | A | 12/1976 | Naka | | |
| 4,018,423 | A * | 4/1977 | Belew | A62B 1/12 | 182/238 |
| 4,125,142 | A | 11/1978 | Fohl | | |
| 4,253,545 | A * | 3/1981 | Yui | A62B 1/10 | 182/240 |
| 4,421,209 | A | 12/1983 | Vermette et al. | | |
| 4,434,869 | A | 3/1984 | Roop et al. | | |
| 4,476,956 | A | 10/1984 | Eger | | |
| 4,487,292 | A * | 12/1984 | Smith | A62B 1/10 | 182/234 |
| 4,577,725 | A | 3/1986 | Hunter | | |
| 4,589,519 | A | 5/1986 | Hunter | | |
| 4,589,523 | A | 5/1986 | Olson et al. | | |
| 4,598,792 | A | 7/1986 | Lew et al. | | |
| 4,598,793 | A | 7/1986 | Lew et al. | | |
| 4,623,038 | A * | 11/1986 | Stancato | A62B 1/10 | 182/234 |
| 4,679,656 | A | 7/1987 | Lew et al. | | |
| 4,688,657 | A | 8/1987 | Erickson | | |
| 4,694,934 | A | 9/1987 | Erickson | | |
| 4,702,348 | A | 10/1987 | Lew et al. | | |
| 4,737,065 | A | 4/1988 | Ju | | |
| 4,793,436 | A | 12/1988 | Lew et al. | | |
| 4,830,340 | A | 5/1989 | Knitig | | |
| 4,877,110 | A | 10/1989 | Wolner | | |
| 4,938,435 | A * | 7/1990 | Varner | B64D 25/00 | 182/231 |
| 5,076,395 | A * | 12/1991 | Kikuchi | A62B 1/10 | 182/234 |
| 5,127,631 | A * | 7/1992 | Flaig | B66D 1/54 | 182/239 |
| 5,186,289 | A * | 2/1993 | Wolner | A62B 1/12 | 182/232 |
| 5,280,828 | A * | 1/1994 | Reynoso | F16D 59/00 | 188/184 |
| 5,305,852 | A | 4/1994 | Klokseth | | |
| 5,343,976 | A * | 9/1994 | Ostrobrod | A62B 35/0093 | 182/237 |
| 5,447,280 | A * | 9/1995 | Feathers | A62B 35/0093 | 182/237 |
| 5,701,972 | A * | 12/1997 | Bloder | A62B 1/14 | 182/234 |
| 5,829,548 | A * | 11/1998 | Ostrobrod | E06C 7/18 | 182/18 |
| 5,878,855 | A | 3/1999 | Miyata | | |
| 5,927,438 | A | 7/1999 | Ostrobrod | | |
| 6,085,368 | A | 7/2000 | Robert et al. | | |
| 6,182,789 | B1 * | 2/2001 | Okamura | A62B 1/02 | 182/7 |
| 6,182,791 | B1 | 2/2001 | Cope | | |
| 6,279,682 | B1 * | 8/2001 | Feathers | A62B 35/0093 | 182/239 |
| 6,494,292 | B2 | 12/2002 | Cope | | |
| 6,550,597 | B2 | 4/2003 | Taniguchi | | |
| 7,097,005 | B2 * | 8/2006 | Angermann | A62B 1/10 | 188/130 |
| 7,258,324 | B2 | 8/2007 | Gilman | | |
| 7,281,620 | B2 | 10/2007 | Wolner et al. | | |
| 7,845,467 | B2 * | 12/2010 | Petzl | A62B 1/14 | 182/193 |
| 8,061,479 | B2 * | 11/2011 | Harris, Jr. | A62B 35/0093 | 182/3 |
| 8,245,817 | B2 * | 8/2012 | Casebolt | A62B 1/10 | 182/231 |
| 2002/0179372 | A1 * | 12/2002 | Schreiber | A62B 1/10 | 182/238 |
| 2004/0065508 | A1 | 4/2004 | Avots et al. | | |
| 2005/0051659 | A1 | 3/2005 | Wolner et al. | | |
| 2006/0113147 | A1 | 6/2006 | Harris, Jr. | | |
| 2007/0261921 | A1 | 11/2007 | Gal et al. | | |
| 2008/0128221 | A1 | 6/2008 | Rogge | | |
| 2009/0173578 | A1 * | 7/2009 | Renton | A62B 1/08 | 182/235 |
| 2011/0278095 | A1 * | 11/2011 | Hetrich | A62B 1/10 | 182/231 |

FOREIGN PATENT DOCUMENTS

| | | | | |
|---|---|---|---|---|
| DE | 2919216 | A1 | 11/1980 | |
| DE | 19818688 | C1 | 1/2000 | |
| DE | 10210969 | A1 | 10/2003 | |
| DE | 202006020127 | U1 | 11/2007 | |
| DE | 202007013135 | UI | 4/2008 | |
| FR | 2654940 | A1 | 5/1991 | |
| GB | 999553 | A | 7/1965 | |
| GB | 2 256 413 | A | 12/1992 | |
| GB | 2256413 | | 12/1992 | |
| GB | 2256413 | A * | 12/1992 | A62B 1/10 |
| GB | 2 306 107 | A | 4/1997 | |
| WO | WO 2006/094486 | A1 | 9/2006 | |

OTHER PUBLICATIONS

"Retrieval Instructions—To Engage and Disengage the Function Winch—Retractable Type Fall Arrester—AD515, EN360-EN1496 Classe B", Protecta® International, Carros, Cedex, France, 4 pages (known of prior to filing of U.S. Appl. No. 12/400,208).

User Instruction Manual Rollgliss® Rescue Emergency Descent Device with Manual Retract, High-Speed, DBI/SALA®, Form 5902152 Rev: A, 12 pages (© 2000 DB Industries, Inc.).

"User Instruction Manual Fisk Descender", DBI SALA®, Form 5902142 Rev: D, 36 pages (© 2002 DB Industries, Inc.).

Fiche technique, Tractel Group, 3 pages (© TRACTEL S.A.S. 2003).

User Instruction Manual For Rescue/Personnel Riding System Rollgliss R350, DBI/SALA®, Form 5902125 Rev: A, 28 pages (© 2004, DB Industries, Inc.).

"User Instruction Manual—Sealed Self Retracting Lifelines", DBI/SALA®, Form 5902122 Rev: G, 26 pages (© 2004—DB Industries, Inc.).

Protecta, Instructions for Use AD Series Self Retracting Lifelines, Form 5902290 Rev: F, 2 pages (© Protecta 2005).

"User Instruction Manual Rescumatic® Emergency Escape Device and Rescue Cradle", DBI SALA®, Form 5906277 Rev: F, 16 pages (© 2005, DB Industries, Inc.).

FALLSTOP® Safety, BORNACK, pp. 55-64 (© Bornack 2007).

"Sealed Self Retracting Lifeline—Revolutionary Sealed Design Stands-Up to Even the Harshest Environments for Ultimate Safety and Reliability!", DBI/SALA®, 2 pages (© 2007—Capital Safety).

"User Instructions Manual Self Retracting Lifelines", DBI SALA®, 40 pages Form: 5902101C Rev: I (© 2007, DB Industries, Inc.).

Fall Arrest Block UB157, ISC (International Safety Components Ltd.), Bangor, Gwynedd, United Kingdom, 4 pages (Printed Sep. 14, 2007).

User Instruction Manual Rollgliss® Rescue Emergency Descent Device with Auto-Retract, DBI SALA®, Form No. 5902105 Rev. B, 16 pages (© 2008, DB Industries, Inc.).

International Search Report for PCT/US2010/024896.

The Non-Final Office Action U.S. Appl. No. 12/620,671 mailed Jan. 19, 2012 (10 pgs.).

The Final Office Action U.S. Appl. No. 12/620,671 mailed Jul. 18, 2012 (12 pgs.).

The Non-Final Office Action U.S. Appl. No. 12/620,671 mailed Jul. 8, 2014 (11 pgs.).

(56) References Cited

OTHER PUBLICATIONS

The Non-Final Office Action U.S. Appl. No. 12/620,671 mailed Feb. 24, 2015 (13 pgs.).
The Final Office Action U.S. Appl. No. 12/620,671 mailed Sep. 10, 2015 (17 pgs.).
The Advisory Action U.S. Appl. No. 12/620,671 mailed Dec. 9, 2015 (4 pgs.).
The Non-Final Office Action U.S. Appl. No. 12/620,671 mailed Mar. 24, 2016 (19 pgs.).
The Final Office Action U.S. Appl. No. 12/620,671 mailed Aug. 18, 2016 (20 pgs.).
The Advisory Action U.S. Appl. No. 12/620,671 mailed Oct. 14, 2016 (4 pgs.).
Modern Language Association (MLA): "sealed." Dictionary.com Unabriged. Random House, Inc. Jan. 16, 2012. <Dictionary.com http://dictionary.reference.com/browse/sealed>.

* cited by examiner

FIG. 2
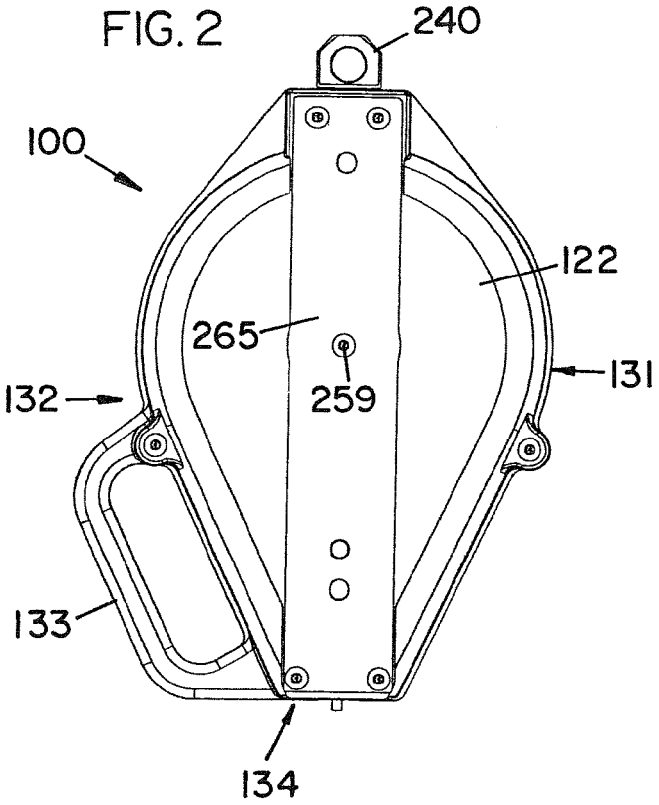
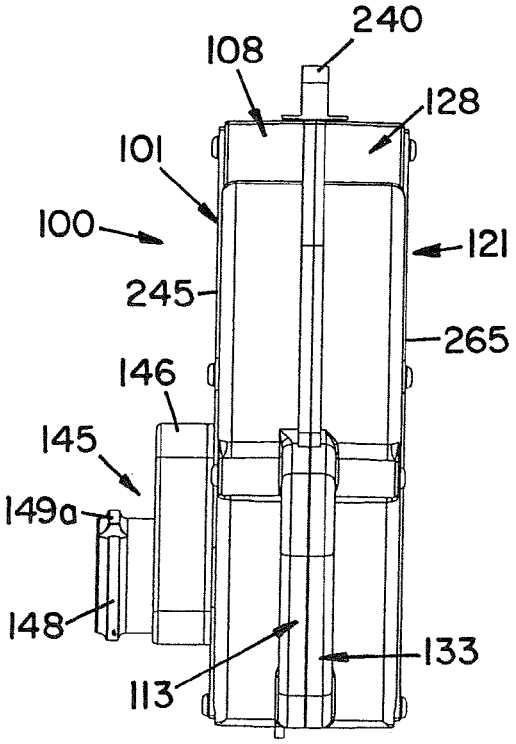
FIG. 3

FIG. 9
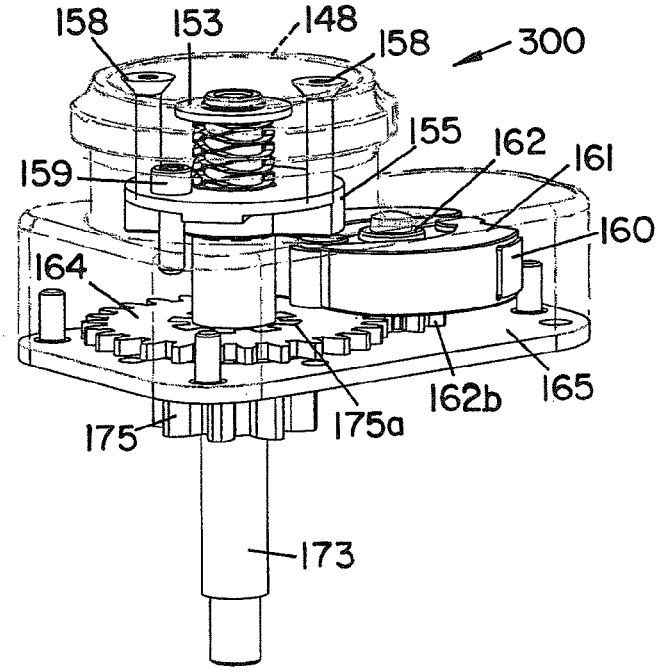
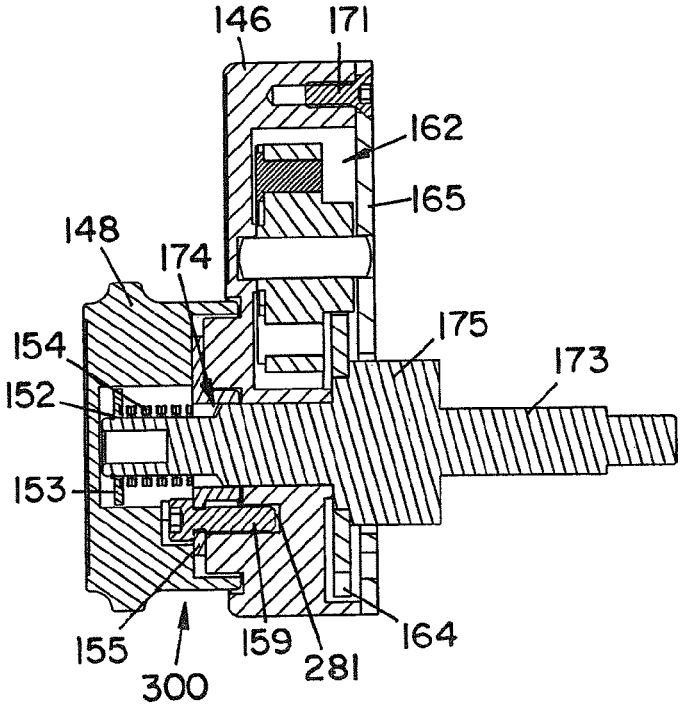
FIG. 10

SAFETY DEVICE WITH FALL ARREST AND DESCENDING MODES

FIELD OF THE INVENTION

The present invention relates to a safety device with fall arrest and descending modes.

BACKGROUND

Safety devices are well known in the art of fall protection safety equipment for use by workers performing tasks during which there is a risk a fall may occur. One type of safety device commonly used is a self-retracting lifeline, which is typically connected to a support structure within the vicinity the worker is performing the task, and the end of the cable is typically connected to a safety harness worn by the worker. Self-retracting lifelines generally include a housing containing a drum around which a cable, rope, or webbing is wound. The drum is spring biased to pay out cable as tension pulling the cable is applied and to retract any of the cable that has been unwound from the drum as the tension on the cable is reduced or released. The housing also includes a brake assembly for stopping rotation of the drum when the cable suddenly unwinds from the drum at a rate greater than a predetermined maximum angular velocity. As the rotation of the drum is stopped, additional cable is prevented from being paid out of the housing to stop the fall of the worker.

Should a fall occur, or should the worker need to otherwise be rescued, the worker may require assistance to reach safety. In such situations, another type of safety device, a controlled descent device, may be used to assist the worker to safety.

For the reasons stated above and for other reasons stated below, which will become apparent to those skilled in the art upon reading and understanding the present specification, there is a need in the art for a safety device with fall arrest and descending modes.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In an embodiment safety device with fall arrest and descending modes, a drum is rotatably operatively connected to a housing. A lifeline has an intermediate portion interconnecting a first end and a second end. The first end is operatively connected to the drum. A first brake assembly is operatively connected to the drum, and a second brake assembly is operatively connected to the drum. A control is operatively connected to the first and second brake assemblies and has a first position and a second position. The first position selectively engages the first brake assembly and the second position selectively engages the second brake assembly.

In an embodiment safety device with fall arrest and descending modes, a drum is rotatably operatively connected to a housing. A lifeline has an intermediate portion interconnecting a first end and a second end. The first end is operatively connected to the drum, at least a portion of the intermediate portion is wound about the drum, and the second end is operatively connected to a hook. A first brake assembly and a second brake assembly are operatively connected to the drum. The first brake assembly includes a rotor to which at least one first pawl having a friction pad is pivotally operatively connected and a first spur gear. The rotor includes a rotor gear. The first spur gear includes inner teeth and outer teeth. The second brake assembly includes a gear assembly and at least one second pawl. The gear assembly includes a second spur gear. A shaft includes first and second teeth and operatively connects the first and second brake assemblies. The inner teeth of the first spur gear mate with the first teeth of the shaft and the outer teeth mate with the rotor gear to interconnect the shaft and the rotor. The second spur gear mates with the second teeth of the shaft. A control is operatively connected to the shaft and has a first position and a second position. The first position allows the shaft to rotate and selectively engages the first brake assembly in a descending mode in which the friction pad contacts the housing when the rotor rotates. The second position locks the shaft and selectively engages the second brake assembly in a fall arrest mode in which the at least one second pawl is operatively connected to the drum and is configured and arranged to engage the gear assembly when the drum rotates at a predetermined speed.

An embodiment brake assembly comprises a housing, at least one pawl, a rotor, and an engaging surface. The at least one pawl includes a pivot end and a free end. The pivot end includes a first side and a second side, and the first side includes a flanged portion. The rotor includes a base and at least one receiver operatively connected to the base. The at least one receiver is configured and arranged to receive the pivot end of the at least one pawl, and the pivot end is pivotally operatively connected to the at least one receiver. The flanged portion is positioned proximate one side of the at least one receiver between the rotor and the housing. The engaging surface is proximate the at least one pawl. The at least one pawl pivots outward relative to the rotor when the rotor is rotated to engage the engaging surface.

In an embodiment method of using a safety device having fall arrest and descending modes, the device comprises a housing, a drum rotatably operatively connected to the housing, a lifeline having an intermediate portion interconnecting a first end and a second end, the first end being operatively connected to the drum, a first brake assembly and a second brake assembly operatively connected to the drum, a shaft interconnecting the first and second brake assemblies, and a control operatively connected to the shaft and having a first position and a second position, the first position allowing the shaft to rotate and selectively engaging the first brake assembly in a descending mode, the second position locking the shaft and selectively engaging the second brake assembly in a fall arrest mode. The method comprises positioning the control in the second position thereby locking the shaft and activating the second brake assembly in the fall arrest mode.

The method further comprising positioning the control in the first position thereby allowing the shaft to rotate and activating the first brake assembly in the descending mode.

The method further comprising positioning the control in the first position thereby allowing the shaft to rotate and activating the first brake assembly in the descending mode after a fall has occurred.

BRIEF DESCRIPTION OF THE DRAWINGS

The present invention can be more easily understood, and further advantages and uses thereof can be more readily apparent, when considered in view of the detailed description and the following Figures in which:

FIG. 2 is a rear view of the safety device shown in FIG. 1;

FIG. 3 is a side view of the safety device shown in FIG. 1;

FIG. 9 is a perspective view of the control and the descending assembly in the fall arrest mode;

FIG. 10 is a cross-section view of the control and the descending assembly in the fall arrest mode;

In accordance with common practice, the various described features are not drawn to scale but are drawn to emphasize specific features relevant to the present invention. Reference characters denote like elements throughout the Figures and the text.

DETAILED DESCRIPTION OF A PREFERRED EMBODIMENT

Figure 1:
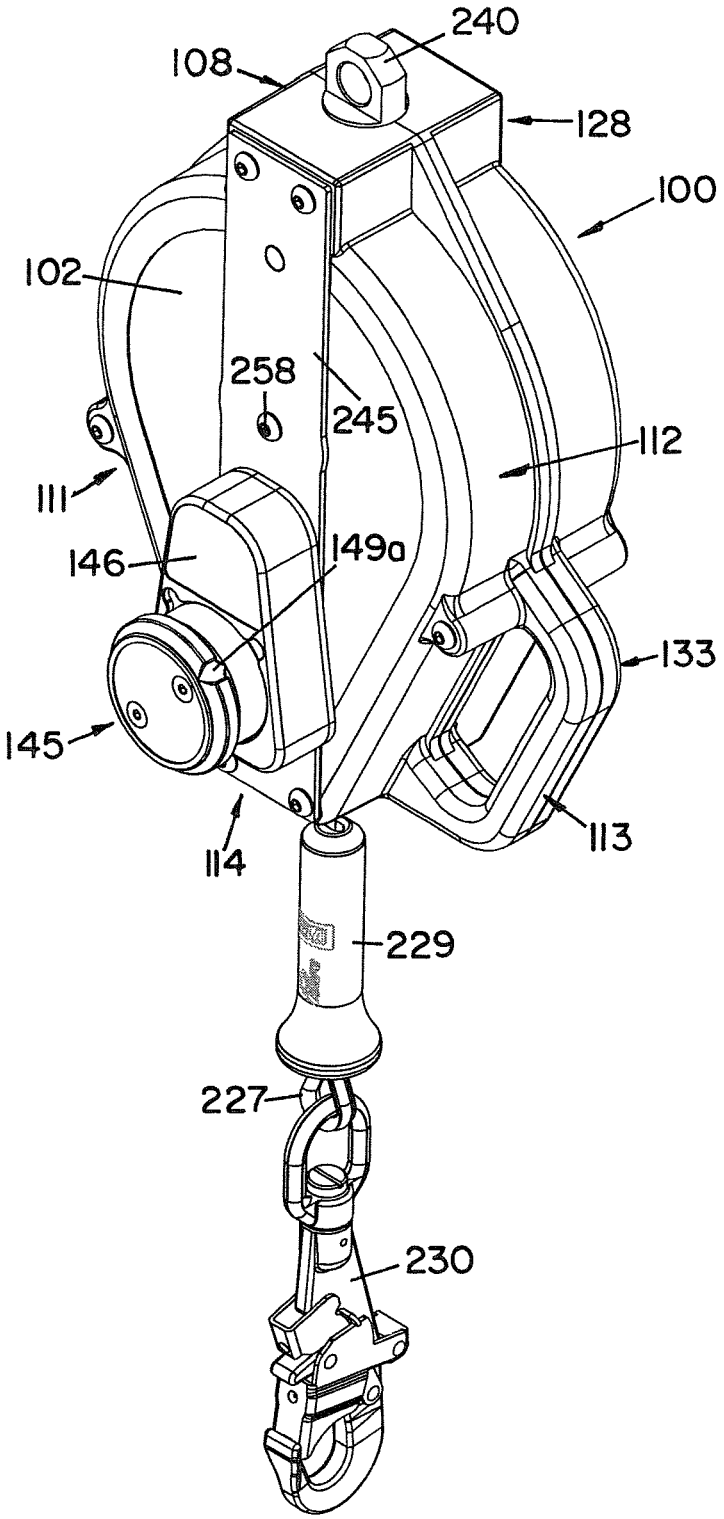
FIG. 1 is a front perspective view of a safety device with fall arrest and descending modes constructed according to the principles of the present invention.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

One embodiment safety device constructed in accordance with the principles of the present invention is designated by the numeral 100 in the drawings. The safety device 100 includes a front housing portion 101 and a rear housing portion 121 that form a cavity in which some of the other components are housed. The front housing portion 101 includes a front plate 102, which includes a protrusion 103 proximate the top, a center aperture 104, a bottom opening 105 with apertures 106 proximate the sides and the bottom of the bottom opening 105, and bottom apertures 107 below the bottom opening 105. A top 108, a first side 111, a second side 112, and a bottom 114 extend outward from the front plate 102 to form a cavity (not shown) therebetween. The top 108 includes a notch or an opening 110 providing access to a cavity (not shown) configured and arranged to receive a portion of a swivel eye 240. The second side 112 includes a handle portion 113 proximate the middle and the bottom of the second side 112. The bottom 114 includes a notch or an opening 116 providing access to a cavity 117.

The rear housing portion 121 includes a rear plate 122, which includes a center aperture 124 and other apertures (not shown). A top 128, a first side 131, a second side 132, and a bottom 134 extend outward from the rear plate 122 to form a cavity 137. The top 128 includes a notch or an opening 130 providing access to a cavity 129 configured and arranged to receive a portion of the swivel eye 240. The second side 132 includes a handle portion 133 proximate the middle and the bottom of the second side 132. Within the cavity 137 proximate the bottom 134 is a partition 135 extending from the second side 132 to proximate the first side 131 with a gap between the partition 135 and the first side 131. The bottom 134 includes a notch or an opening 136 providing access to a cavity 138.

Figure 5A:
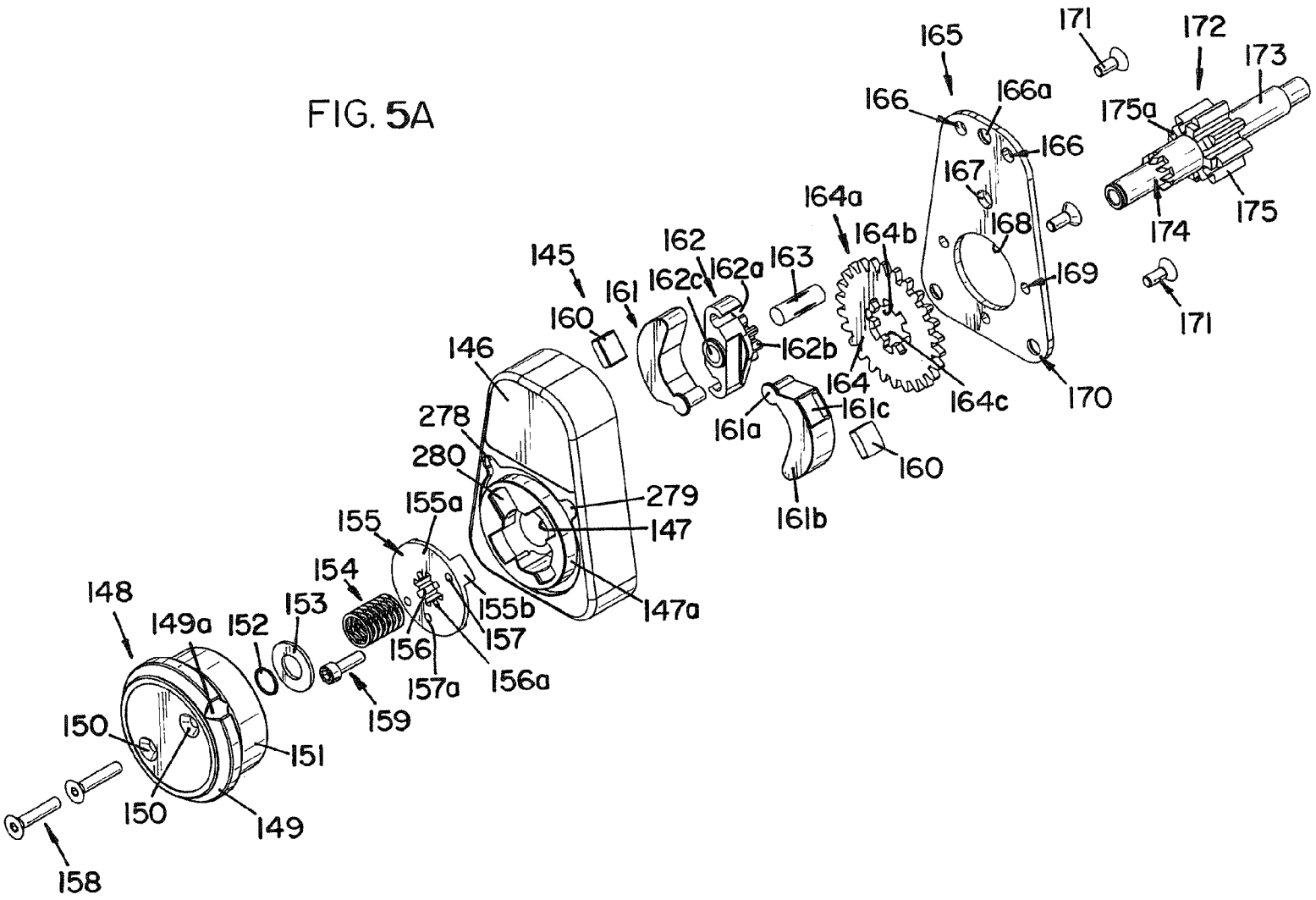
FIG. 5A is an exploded front perspective view of a control and descending assembly of the safety device shown in FIG. 1.
Figure 5B:
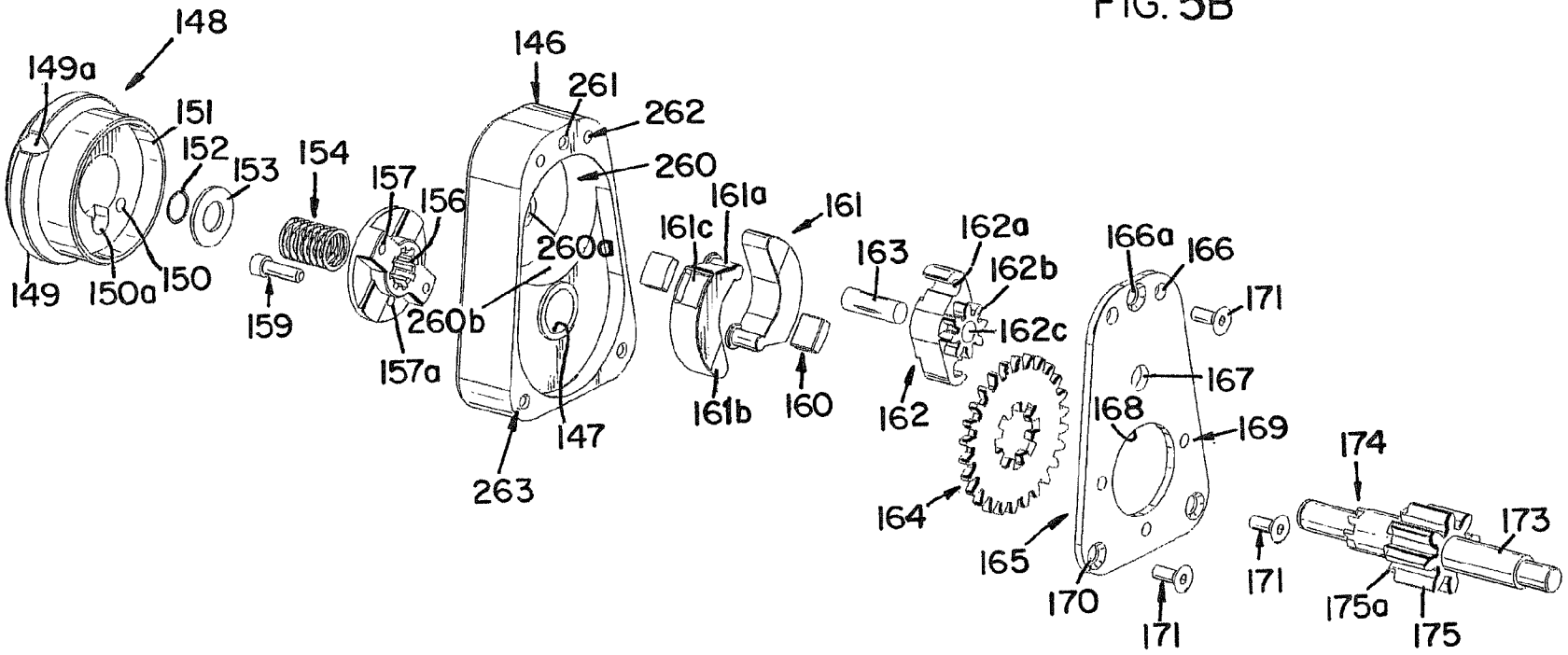
FIG. 5B is an exploded rear perspective view of the control and descending assembly shown in FIG. 5A.

A control and descending assembly 145 is operatively connected to the front plate 102 proximate the bottom opening 105. The assembly 145, which is shown in FIGS. 5A and 5B, includes a housing 146, which houses some of the other assembly components, and a control knob 148 operatively connected to the housing 146. Proximate the bottom of the front side, the housing 146 includes a bore 147 with a flanged portion 147*a* extending outward proximate the perimeter of the bore 147. Proximate the flanged portion 147*a*, the bore 147 includes notches 280, preferably spaced approximately ninety degrees apart. In the orientation shown in FIG. 5A, the top right notch 280 is deeper than the top left notch 280, which allows the spline sleeve 155 to have an inward and an outward position or engagement relative to the housing 146. The spline sleeve 155 is in the inward position when the position indicator 149*a* is positioned proximate the top right notch 280, and the spline sleeve 155 is in the outward position when the position indicator 149*a* is positioned proximate the top left notch 280. When the spline sleeve 155 is in the inward position, it is engaged with the pinion gear 172 and locked. When the spline sleeve 155 is in the outward position, it is disengaged from the pinion gear 172 and unlocked. Relative to the front of the assembly 145, between the bottom left and right notches 280 is a recessed portion 281, which extends further into the housing 146. Proximate the top two notches 280 on opposing sides of the flanged portion 147*a* are slots 278 and 279.

As shown in FIG. 5B, the rear side of the housing 146 includes a cavity 260 with sides 260*b*. Within the cavity 260, the side proximate the front of the housing 146 includes a receiver 260*a*. Above the cavity 260 is a bore 261 with an aperture 262 on each side. The bore 147 extends through the housing 146 between the cavity 260 and the bottom of the housing 146. The bottom of the housing 146 includes a bore 263 on each side of the bottom.

The knob 148 includes a flange portion 149, which preferably has a knurled outer surface and a position indicator 149*a*, and a cylindrical portion 151 extending outward from the flange portion 149. Bores 150 extend axially through the knob 148. The cylindrical portion 151 is configured and arranged to house some of the components of the assembly 145. A spline sleeve 155 is generally washer-shaped with tabs 155*b* extending outward from the base portion 155*a*. The tabs 155*b* are configured and arranged to correspond with the notches 280 in the housing 146. A bore 156 extends through the center of the base portion 155*a*, and apertures 157 and 157*a* are positioned around the bore 156. Apertures 157 are on opposing sides of the bore 156, and aperture 157*a* is on a side of the bore 156 between apertures 157. The surface of the base portion 155*a* forming the bore 156 includes teeth 156*a*. A spring 154 is positioned proximate the bore 156, and a washer 153 and a spiral ring 152 are positioned between the spring 154 and the front plate portion of the knob 148. The spring 154 exerts a biasing force against the spline sleeve 155, which moves inwardly and outwardly relative to the housing 146.

Fasteners 158 extend through bores 150 of the knob 148 and into the two opposing apertures 157 of the spline sleeve 155 to connect the knob 148 and the spline sleeve. Fastener 159 extends through the aperture 157*a* between the opposing apertures 157 and is configured and arranged to be received in the recessed portion 281 when the control and descending assembly 145 is in select positions relative to the housing 146.

Figure 16:
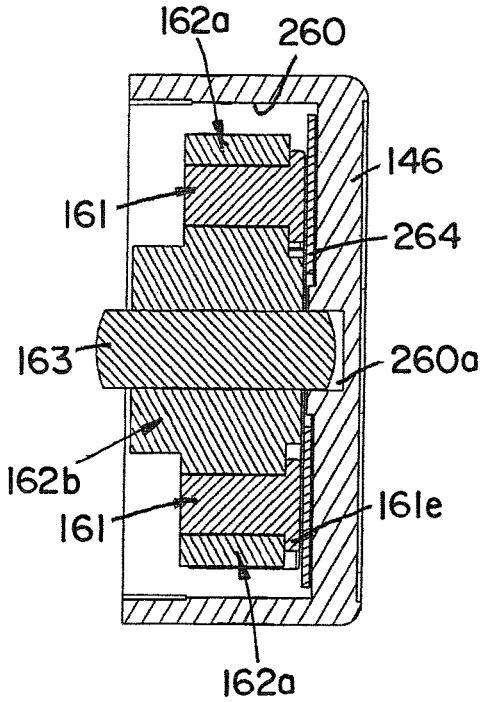
FIG. 16 is a cross-section view of the first brake assembly taken proximate the rotation axis of the assembly shown in FIG. 15.
Figure 15:
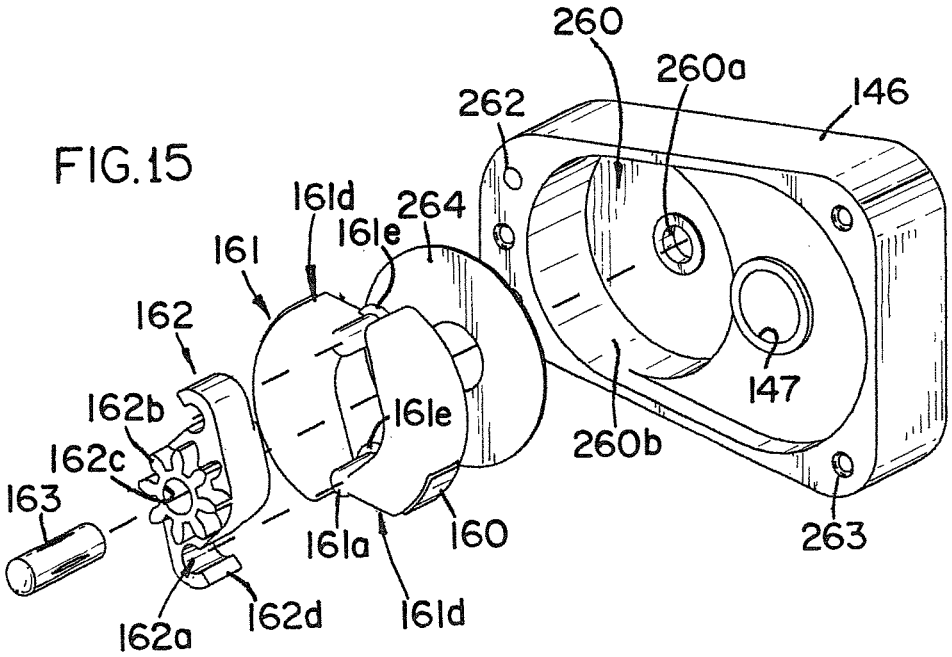
FIG. 15 is an exploded perspective view of a first brake assembly of the control and descending assembly shown in FIGS. 5A and 5B.

Positioned above the knob 148, on the opposing side of the housing 146, is a first brake assembly. The first brake assembly includes a rotor 162, pawls 161, and friction pads 160, which fit within the cavity 260. The rotor 162 includes a base from which pivot receivers 162*a* extend on opposing sides of the base and to which a gear 162*b* is operatively connected. The ends of the pivot receivers 162*a* include relatively flat surfaces 162*d*. A bore 162*c* extends through the base and the gear 162*b*. Each of the pawls 161 includes a pivot portion 161*a*, which is configured and arranged to fit and pivot within the respective pivot receiver 162*a*. Each pivot portion 161*a* includes a flanged portion 161*e* proximate one side of the pivot portion 161*a*. Each of the pawls 161 also includes a free end 161*b* and a pad receiver 161*c*. The pad receiver 161*c* is positioned on the outer surface of the pawl 161 between the pivot portion 161*a* and the free end 161*b*. The pad receiver 161*c* is configured and arranged to receive a portion of a friction pad 160. Each of the pawls 161 also includes a relatively flat surface 161*d* proximate between the pivot portion 161*a* and the pad receiver 161*c*. An optional disk 264, preferably made of a plastic having a low coefficient of friction, could be positioned between the pawls 161 and the housing 146 to reduce the friction of the flanged portions 161*e* on the housing 146. The disk 264 is shown in FIGS. 15 and 16 but is not shown in FIGS. 5A and 5B. A groove pin 163 extends through the bore 162*c*, and one end of the groove pin 163 fits within the receiver 260*a* and the other end fits within the middle aperture 167.

A spur gear 164 includes teeth 164*a* around its outer perimeter, an aperture 164*b*, and teeth 164*c* around the perimeter forming the aperture 164*b*. A base plate 165 has a shape corresponding to the shape of the housing 146 and includes top apertures 166 and 166*a*, a middle aperture 167, a bore 168 with apertures 169 around the sides and bottom of the bore 168, and bottom apertures 170. Fasteners 171 extend through apertures 166*a* and 170 into bores 261 and 263 to connect the base plate 165 to the housing 146.

A pinion gear 172 includes a shaft portion 173 to which first teeth 174 and second teeth 175 are operatively connected. The first teeth 174 are proximate one end and the second teeth 175 are proximate the middle of the shaft portion 173. The second teeth 175 include a male portion 175*a*, which extends outward with a smaller diameter from the second teeth 175. The male portion 175*a* is configured and arranged to mate with the teeth 164*c* of the spur gear 164. The ends of the shaft portion 173 preferably have a smaller diameter than the middle of the shaft portion 173.

When the assembly 145 is assembled, the pinion gear 172 extends through the bore 168 of the base plate 165, the aperture 164*b* of the spur gear 164, the bore 147 of the housing 146, the bore 156 of the spline sleeve 155, the bore of the spring 154, the aperture of the washer 153, and the aperture of the spiral ring 152. Because the knob 148 is connected to the spline sleeve 155, the knob 148 is connected to the pinion gear 172 via the spline sleeve 155. Because the spring 154 is fixedly connected to the end of the shaft portion 173 proximate the first teeth 174, the spring 154 exerts a biasing force against the spline sleeve 155 toward the housing 146. The first teeth 174 mate with the teeth 156*a* of the spline sleeve 155, and the male portion 175*a* of the second teeth 175 mate with the teeth 164*c* of the spur gear 164. The teeth 164*a* of the spur gear 164 mate with the teeth of the gear 162*b*.

As shown in FIGS. 15 and 16, the pivot receivers 162*a* receive the respective pivot portions 161*a* of the pawls 161, and the flanged portions 161*e* are positioned proximate one side of the rotor 162 between the rotor 162 and the housing 146. The flanged portions 161*e* prevent the pivot portions 161*a* from sliding out of the pivot receivers 162 from the opposite side of the rotor 162. Although this rotor and pawl arrangement is shown with respect to the first brake assembly, it is recognized that this arrangement could be used with other types of brake assemblies.

Figure 6:
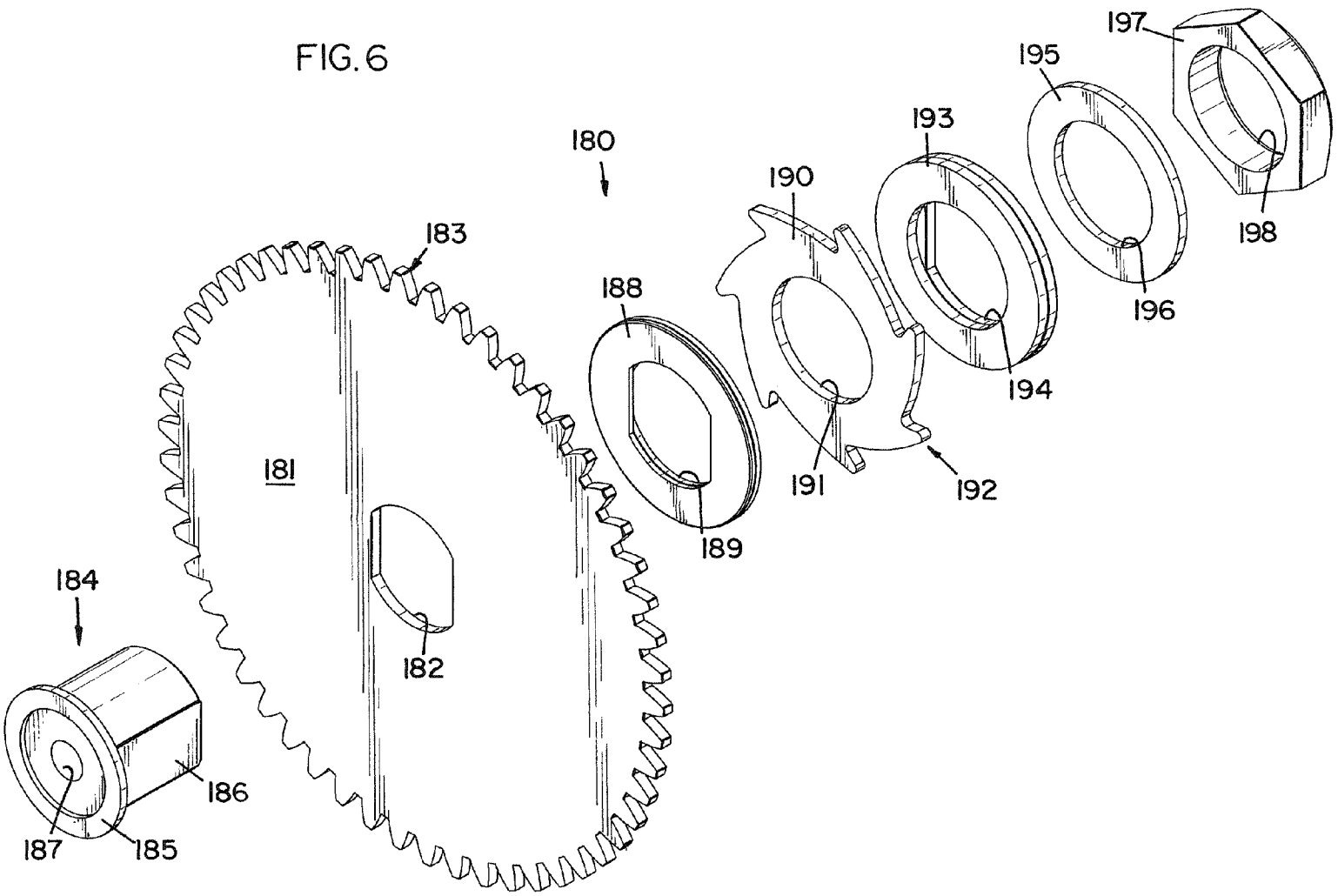
FIG. 6 is an exploded perspective view of a portion of a brake assembly of the safety device shown in FIG. 1.

Proximate the other, inner side of the front housing portion 101 is a gear assembly 180, which is operatively connected to the second teeth 175, which extends through the bottom opening 105 of the front housing portion 101. The gear assembly 180, shown in FIG. 6, includes a hub 184, a spur gear 181, a friction disk 188, a ratchet disk 190, a friction disk 193, a spring disk 195, and a lock nut 197. The hub 184 includes a flange portion 185 and a cylindrical portion 186 extending outward from the flange portion 185. A bore 187 extends longitudinally through the hub 184. The spur gear 181 includes an aperture 182 and teeth 183. The friction disk 188 includes an aperture 189. The ratchet disk 190 includes an aperture 191 and teeth 192. The friction disk 193 includes an aperture 194. The spring disk 195 includes an aperture 196. The lock nut 197 includes an aperture 198. The cylindrical portion 186 extends through the aperture 182 of the spur gear 181, the aperture 189 of the friction disk 188, the aperture 191 of the ratchet disk 190, the aperture 194 of the friction disk 193, the aperture 196 of the spring disk 195. The cylindrical portion 186 has opposing sides that are flat, and the surfaces forming apertures 182, 189, and 194 have corresponding flat portions so that the spur gear 181, the friction disk 188, and the friction disk 193 do not rotate about the cylindrical portion 186. The aperture 198 of the lock nut 197 receives the end of the cylindrical portion 186, and the flange portion 185 of the hub 184 and the lock nut 197 secure the other components to the cylindrical portion 186. The teeth 183 of the spur gear 181 mate with the second teeth 175 of the pinion gear 172.

An isolation disk 202 with an aperture 203 is positioned proximate the gear assembly 180, and a drum 220 is positioned proximate the isolation disk 202. The drum 220 includes a cylindrical hub portion 221 with an end portion 221*a* covering one end and a flange 224 proximate the opposing end extending outward from the hub portion 221.

The end portion 221*a* includes cylindrical portions 222 with apertures and a bore 223 proximate the middle of the end portion 221*a*.

The hub portion 221 forms a cavity in which a portion of the second brake assembly is housed. The second brake assembly includes the gear assembly 180 and pawls 205. Each pawl 205 includes a rocker portion 206, an engaging portion 207, and an extension portion 208. The extension portion 208 extends outward from the respective pawl 205 and fits within the bore formed by the respective cylindrical portion 222 in the end portion 221*a*. Springs 210 bias the pawls 205 in a disengaged position. Each spring 210 includes a first end 211, a second end 212, and a coiled portion 213 between the ends 221 and 212. The first end 211 is operatively connected to the end portion 221*a* and the second end 212 is operatively connected to the respective pawl 205. A shaft 216 extends through the bore 223, and bearings 215 are positioned in the bores of the cylindrical portions 222 and the bore 223. The bearing 235 is positioned proximate the bore 223, and the shaft 216 also extends through the bearing 235.

A cable 225 includes a first end 226 operatively connected to the drum 220 and a second end 227 operatively connected to a hook 230. Proximate the hook 230 is a stop 228, which fits within the cavity 117 proximate the opening 116, and a bumper 229, which protects the second end 227 of the cable 225 and prevents the cable 225 from being completely retracted into the housing. The shear pin 232 creates a reserve portion of the cable 225, and the spacer 233 positions the cable 225 with the shear pin 232 to maintain a consistent breakage point.

A flange 238 is operatively connected to the end portion 221*a* with fasteners 239 extending through apertures 238*a*. An intermediate portion of the cable 225 is wound at least partially around the outside of the hub 221, and the flanges 224 and 238 keep the cable 225 from sliding off the hub 221. An isolation disk 241 is positioned proximate the flange 238, and a spring 242, which is preferably a motor spring, is positioned between the isolation disk 241 and the rear plate 122. One end of the spring 242 is connected to the rear housing portion 121, and the other end of the spring 242 is connected to the shaft 216 via a slot (not shown) receiving the end. The spring 242 exerts a biasing force on the shaft 216.

A front load strap 245 is positioned between the front plate 102 and the control and descending assembly 145. The front load strap 245 includes top apertures 246, an aperture 247 below the top apertures 246, an aperture 248 proximate the middle, apertures 249 below the aperture 248, a bore 250 below the apertures 249, apertures 251 positioned proximate the sides and the bottom of the bore 250, and bottom apertures 252. The fasteners 253 extend through the apertures 246 to connect to the spacers 236, and the fasteners 254 extend through the apertures 252 to connect to the respective coupling hex nuts 234. Alignment pins 177 extend into apertures 249 and extend through top apertures 166 into apertures 262.

A rear load strap 265 is positioned proximate the rear plate 122. The rear load strap 265 includes top apertures 266, an aperture 267 below the top apertures 266, an aperture 268 proximate the middle, apertures 271 below the aperture 268, and bottom apertures 272. The fasteners 273 extend through the apertures 266 to connect to the spacers 236, and the fasteners 274 extend through the apertures 272 to connect to the respective coupling hex nuts 234.

The coupling hex nuts 234*a* and 234*b* and the spacers 236 assist in interconnecting the front and rear housing portions 101 and 121. The tops of the housing portions include bores (only bores 110*a* in top 108 are shown) configured and arranged to receive the spacers 236, which include threaded bores configured and arranged to receive fasteners 253 and 273. Fasteners 253 extend through apertures 246 in the front load strap 245 and into the threaded bores of the spacers 236. Fasteners 273 extend through apertures 266 in the rear load strap 265 and into the threaded bores of the spacers 236. Proximate the sides of the housing portions 101 and 121, the housing portions 101 and 121 form bores 141 configured and arranged to receive the coupling hex nuts 234*a*, which include threaded bores configured and arranged to receive the fasteners 254*a* and 274*a*. The bottoms of the housing portions include bores corresponding with apertures (only apertures 107 are shown) configured and arranged to receive the coupling hex nuts 234*b*, which include threaded bores configured and arranged to receive fasteners 254*b* and 274*b*. Fasteners 254*b* extend through apertures 252 in the front load strap 245 and into the threaded bores of the coupling hex nuts 234*b*. Fasteners 274*b* extend through apertures 272 in the rear load strap 265 and into the threaded bores of the coupling hex nuts 234*b*. A sponge cord 237 helps seal the front and rear housing portions 101 and 121.

When the safety device 100 is assembled, the shaft 216 extends from proximate the front housing portion 101 to the rear housing portion 121. Fastener 258 extends through the aperture 248 in the front load strap 245, through the center aperture 104 in the front plate 102, and into the bore in the shaft 216. Fastener 259 extends through the aperture 268 in the rear load strap 265, through the center aperture 124 in the rear plate 122, and into the bore in the shaft 216. The shaft 216 extends through bore 187 of the gear assembly 180 and the aperture 203 of the isolation disk 202 between the front housing portion 101 and the drum 220, the shaft 216 extends through the bore 223 of the drum and the bearings 215 and 235, and the shaft 216 extends through the aperture 241*a* of the isolation disk 241 and is operatively connected to an end of the spring 242 between the drum 220 and the rear housing portion 121. The end of the spring 242 is inserted into a slot (not shown) proximate the end of the shaft 216 thus placing a biasing force on the shaft 216. The shaft 216 rotates as cable 225 is paid out from around the drum 220 and winds the spring 242 more tightly. Because the spring 242 wants to unwind, the spring 242 places a biasing force on the shaft 216 to automatically retract and wind the cable 225 around the drum 220. If the cable 225 is paid out too quickly from the drum 220, for example should a fall occur, the pawls 205 pivot outwardly and engage the teeth 192 on the ratchet disk 190, which stops the drum 220 from rotating when positioned in a fall arrest mode.

Figure 4:
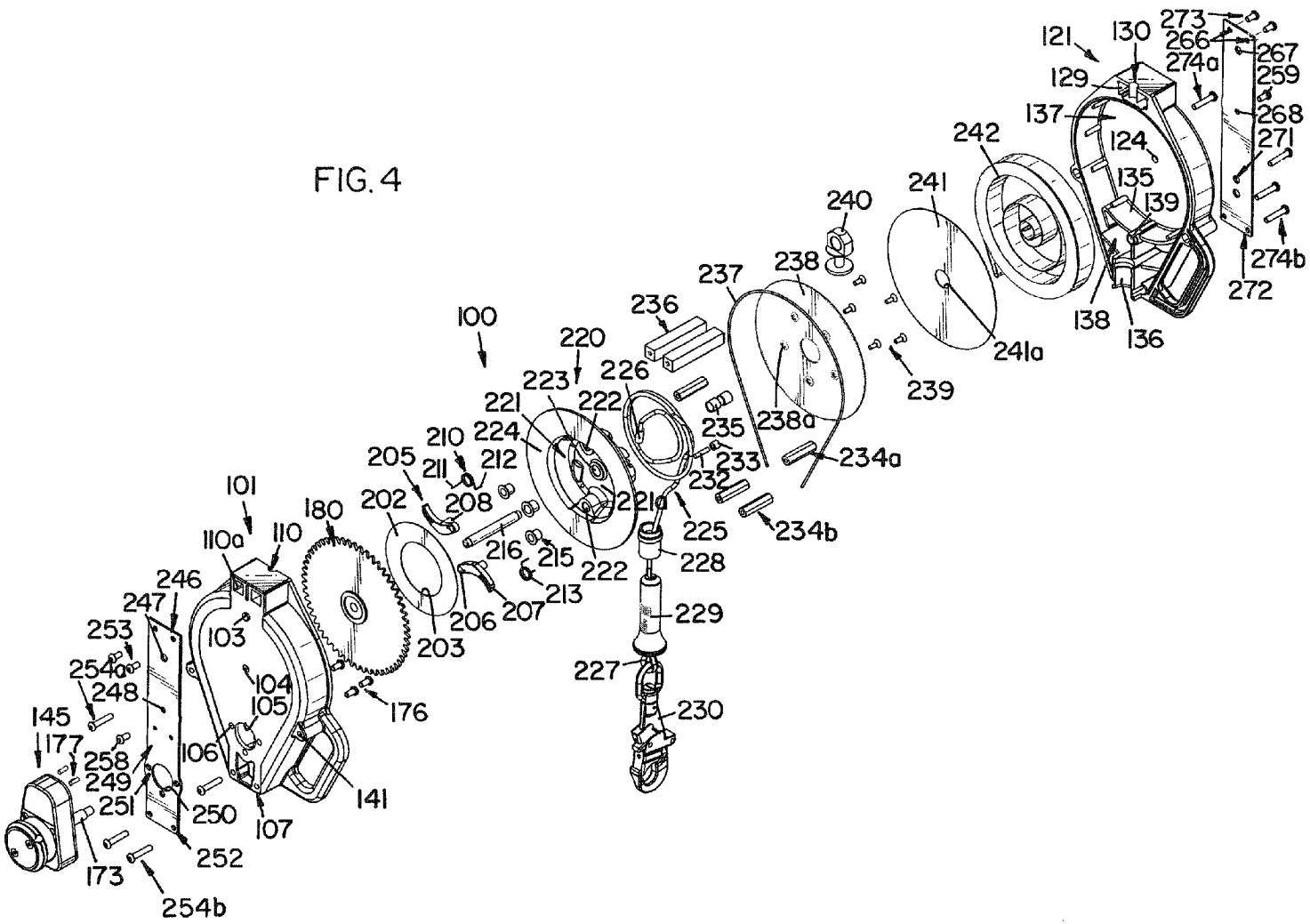
FIG. 4 is an exploded perspective view of the safety device shown in FIG. 1.

As shown in FIG. 4, the fasteners 176 extend through the apertures 106 of the front plate 102, through the apertures 251 of the front load strap 245, and into bores 169 in the base plate 165 to connect the control and descending assembly 145 to the front housing portion 101. The shaft portion 173 and a portion of the second teeth 175 of the pinion gear 172 extend through the bore 250 of the front load strap 245 and through the bottom opening 105 of the front plate 102 so that the male portion 175*a* of the second teeth 175 mate with the teeth 164*c* of the spur gear 164 and the second teeth 175 mate with the teeth 183 of the gear assembly 180. The shaft portion 173 extends further outward into the bore 139 in the rear housing portion 121.

Figure 12:
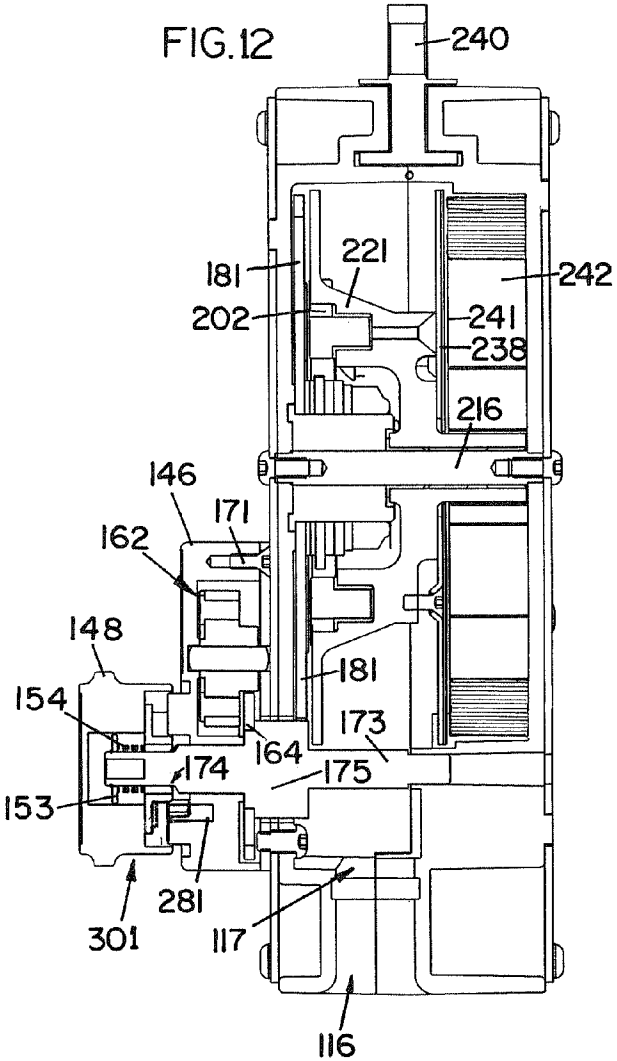
FIG. 12 is a cross-section view of the safety device taken along the lines 12-12 in FIG. 11.
Figure 11:
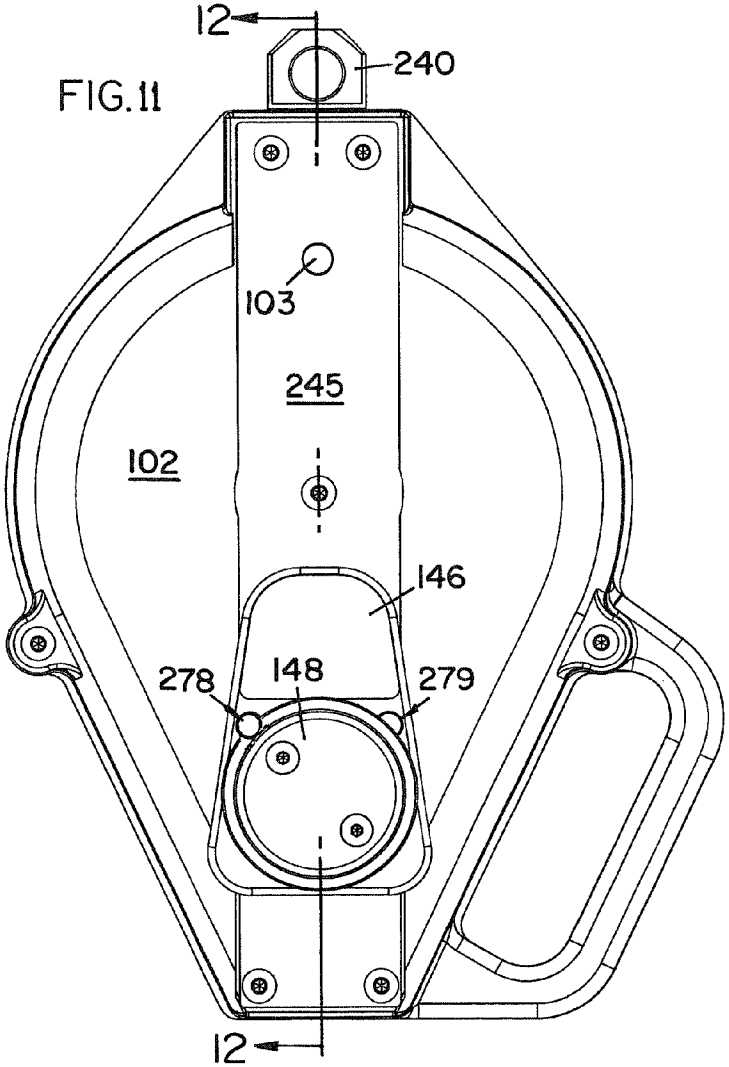
FIG. 11 is a front view of the safety device shown in FIG. 1 in a descending mode.
Figure 13:
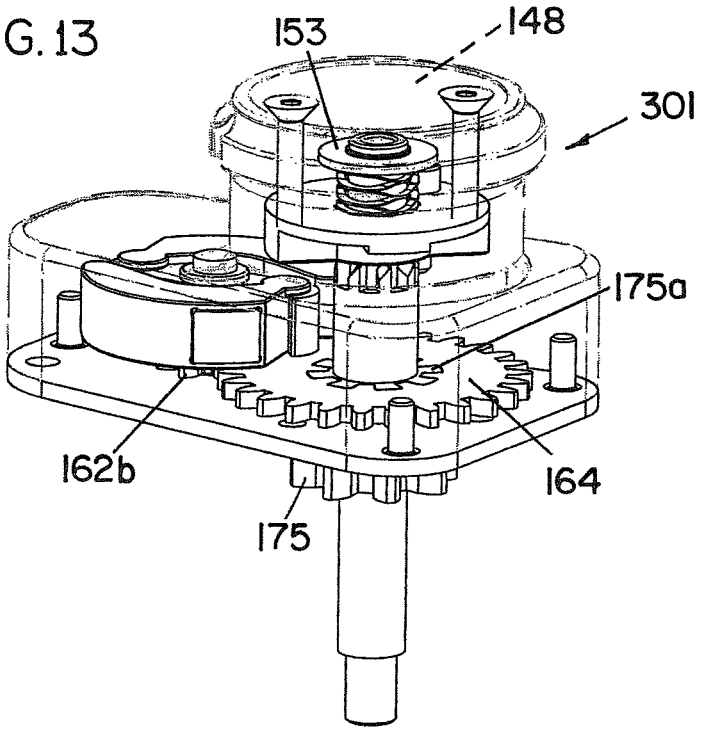
FIG. 13 is a perspective view of the control and the descending assembly in the descending mode.
Figure 14:
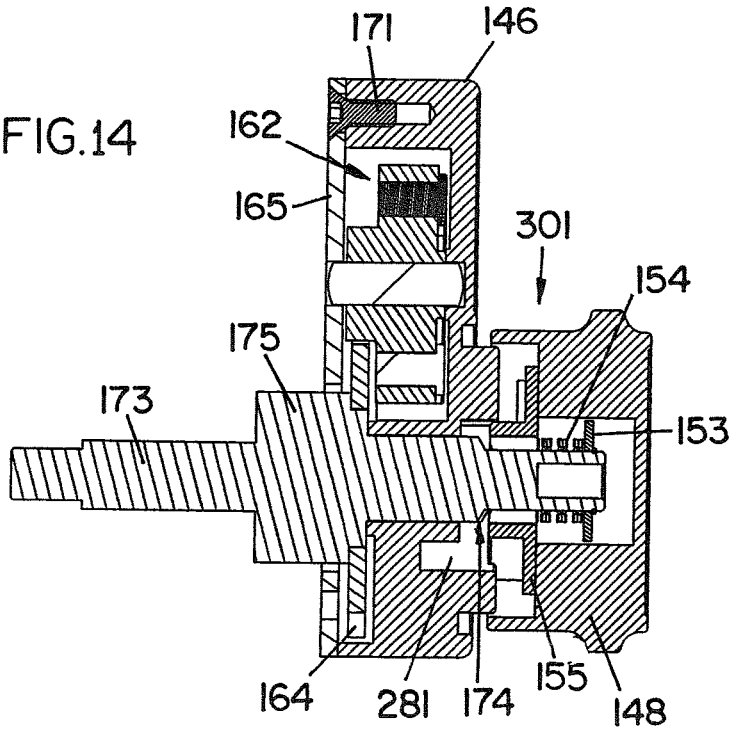
FIG. 14 is a cross-section view of the control and the descending assembly in the descending mode.

When the knob 148 of the control and descending assembly 145 is positioned in the first position 278, the device 100 is positioned in a descending mode, as shown in FIG. 11. In the descending mode, the pinion gear 172 is allowed to rotate because the knob 148 is not locked relative to the housing 146. As shown in FIGS. 12-14, the spline sleeve tabs 155*b* are not engaged by the housing 146 and the knob 148 is in a disengaged position 301, the knob 148 positioned outward relative to the housing 146. Thus, because the pinion gear 172 can rotate, the gear assembly 180 can rotate, and the second brake assembly cannot operate properly. This allows the first brake assembly to operate. When the pinion gear 172 rotates, the spur gear 164 and the rotor 162 rotate, and when the rotor 162 rotates, the pawls 161 pivot outward so that the friction pads 160 contact the sides 260*b* of the housing 146. The friction between the friction pads 160 and the housing 146 slows the rate of rotation of the pinion gear 172, which slows the rate of rotation of the drum 220, which slows the rate the cable 225 is paid out to control the rate of descent of the user connected to the hook 230. The first brake assembly does not include springs so the pawls 161 could pivot outward during use of the device 100. Thus, it is possible the friction pads 160 could contact the sides 260*b* of the housing 146, but until the pinion gear 172 is rotating rapidly, relatively little to no braking force would occur. As the rotational rate increases, the braking force increases. It is recognized that the first brake assembly could also include springs to bias the pawls inward relative to the rotor 162.

The pawls 161 include surfaces 161*d*, which contact the surfaces 162*d* of the rotor 162 when the pawls 161 pivot outward relative to the rotor 162. However, the friction pads 160 contact the sides 260*b* of the housing 146 prior to the surfaces 161*d* and 162*d* contacting each other thus limiting the outward movement of the pawls 161.

Figure 8:
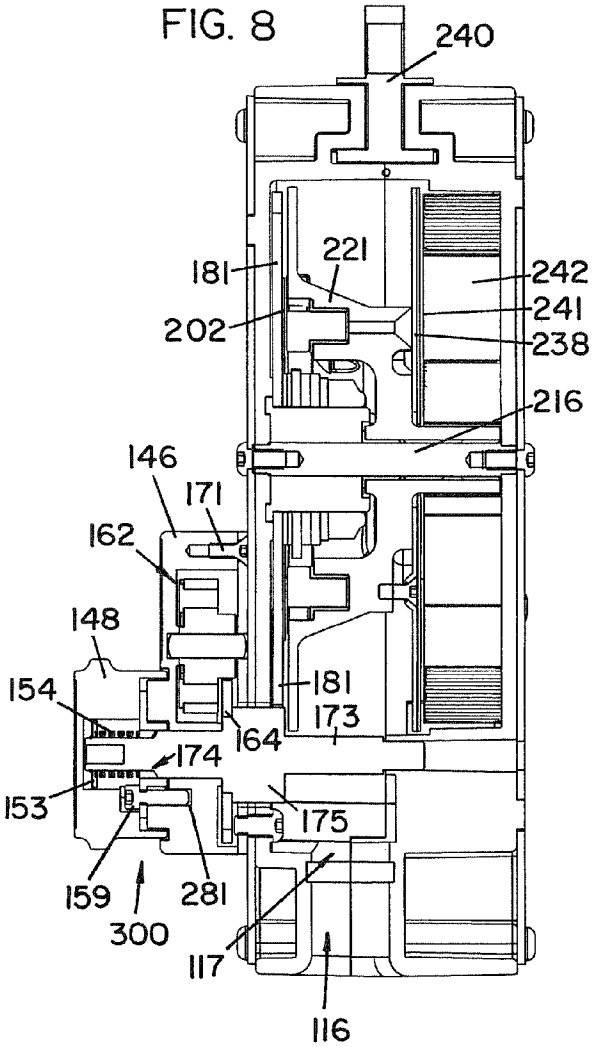
FIG. 8 is a cross-section view of the safety device taken along the lines 8-8 in FIG. 7.
Figure 7:
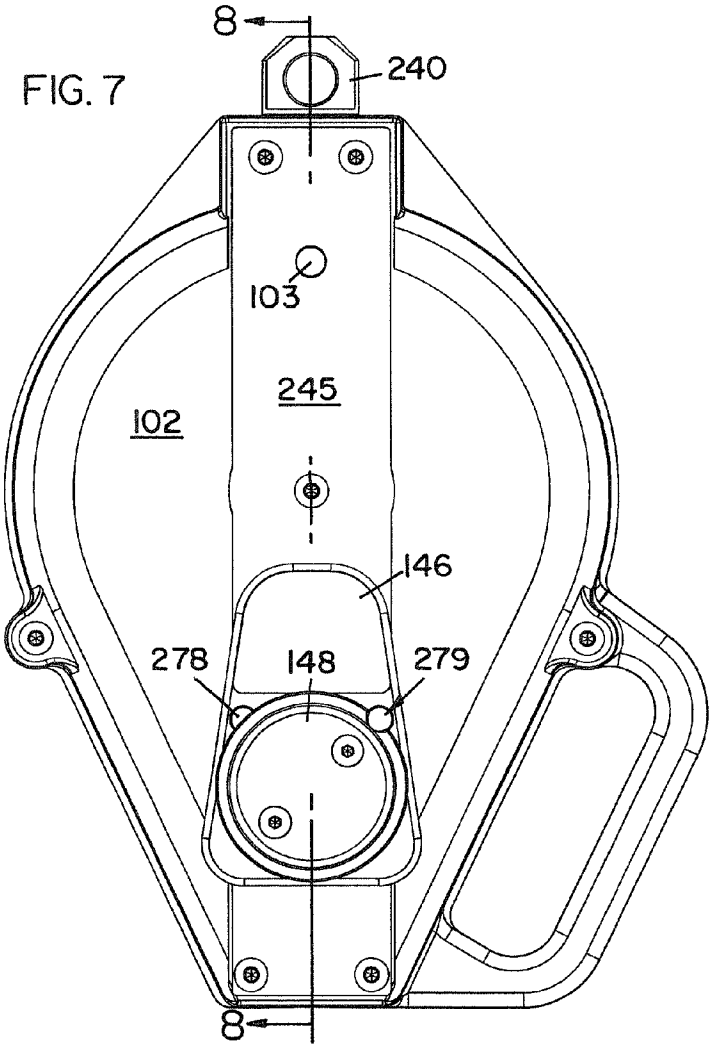
FIG. 7 is a front view of the safety device shown in FIG. 1 in a fall arrest mode.

When the knob 148 is positioned in the second position 279, the device 100 is positioned in a fall arrest mode, as shown in FIG. 7. In the fall arrest mode, the pinion gear 172 does not rotate because the knob 148 is locked relative to the housing 146. As shown in FIGS. 8-10, the spline sleeve tabs 155*b* are engaged by the housing 146 and the knob 148 is in an engaged position 300, the knob 148 positioned inward relative to the housing 146. The tabs 155*b* are received in the respective notches 280 and the fastener 159 is received in the recessed portion 281, as shown in FIGS. 8-10. The fastener 159 and the recessed portion 281 prevent the knob 148 from over-rotating past the positions 278 and 278. The spring 154 places a biasing force on the spline sleeve 155, and thus the knob 148, to keep the knob 148 biased in the second position 279. Thus, because the pinion gear 172 cannot rotate, the gear assembly 180 cannot rotate, and the second brake assembly can operate properly. In other words, the ratchet disk 190 is locked in place so that when the drum 220 rotates at a predetermined speed and the pawls 205 pivot to engage the teeth 192 of the ratchet disk 190, rotation of the drum 220 stops because the gear assembly 180 does not rotate.

In operation, the safety device 100 is operatively connected to a support structure, and the cable is operatively connected to a safety harness donned by a worker. The worker is free to move about the vicinity of the safety device 100, with only the length of the cable restricting the distance of the worker's movement. As the worker moves further away from the safety device 100, cable is paid out of the device as it is unwound from the drum 220. As the worker moves closer to the safety device 100, cable is retracted into the device as it is wound about the drum 220.

A sudden acceleration or predetermined rate of speed at which the drum 220 turns to pay out cable causes the pawls 205 to overcome the forces of the springs 210. The centrifugal force causes the pawls 205 to pivot away from the central portion of the hub 221. The forces of the springs 210 are overcome, the extension portions 208 rotate within the cylindrical portions 222, and the engaging portions 207 move outward so that at least one of the pawls 205 engages at least one of the ratcheting teeth 192 of the gear assembly 180. When the gear assembly 180 is locked in the fall arrest mode, engagement of the gear assembly 180 by at least one of the pawls 205 activates the rest of the second brake assembly. Because the pawls 205 engage the ratcheting teeth 192 and can no longer rotate, the pawls 205 cause the brake hub 184 to rotate. The brake hub 184, which is rotatably mounted to shaft 216 but does not normally rotate about shaft 216, begins to rotate with the pawls 205 and the drum 220. The torque is set to a predetermined level to slow and eventually stop rotation of the brake hub 184. Once at least one of the pawls 205 has engaged at least one of the ratcheting teeth 192, they cannot be disengaged until the drum 220 begins to rotate backward to rewind the cable onto the drum hub 221. If the gear assembly 180 is allowed to rotate in the descending mode, engagement of the gear assembly 180 by at least one of the pawls 205 does not activate the rest of the second brake assembly, and the first brake assembly is activated.

In the descending mode, although the gear assembly 180 is engaged by at least one of the pawls 205, the second brake assembly cannot operate properly because the gear assembly 180 rotates with the pinion gear 172. The rotating pinion gear 172 rotates the spur gear 164, which rotates the gear 162*b* of the rotor 162, which rotates the rotor 162 and the pawls 161. The pivot portions 161*a* of the pawls 161 will pivot within the pivot receivers 162*a* and the free ends 161*b* will move outward relative to the rotor 162 to contact the surface of the housing 146. The friction between the friction pads 160 and the housing 146 slows the rate of rotation of the pinion gear 172, which slows the rate of rotation of the drum 220, which slows the rate the cable 225 is paid out to control the rate of descent of the user connected to the hook 230. This type of centrifugal brake (the first brake assembly) will engage to some degree as the rotor rotates, and the braking force will increase as the angular velocity is increases. Although springs are not used, it is recognized that springs could be used to bias the pawls inward and the brake pads could be prevented from contacting the housing and applying any braking force until a predetermined angular velocity is reached.

In another embodiment, the knob can be moved from the second position (fall arrest mode) to the first position (descending mode) after a fall has occurred. A tool (not shown) could be used to assist in moving the knob outward, thus disengaging the fall arrest system and allowing the descending system to function, and the knob can be rotated to the first position. Once the knob is pulled outward (disengaging the spline sleeve from the pinion gear) the descending system will function.

The above specification, examples, and data provide a complete description of the manufacture and use of the composition of embodiments of the invention. Since many embodiments of the invention can be made without departing from the spirit and scope of the invention, the invention resides in the claims hereinafter appended.

We claim:

1. A safety device with fall arrest and descending modes, comprising:

a housing;

a drum rotatably operatively connected to the housing;

a lifeline having an intermediate portion interconnecting a first end and a second end, the first end being operatively connected to the drum;

a first brake assembly operatively connected to the drum, the first brake assembly configured and arranged to frictionally control a pay out of the lifeline based solely on the weight of a user during a decent;

a second brake assembly operatively connected to the drum, the second brake assembly configured and arranged to be used during a fall event; and a control operatively connected to the first and second brake assemblies and having a first position and a second position, the first position selectively engaging the first brake assembly and the second position selectively engaging the second brake assembly.

2. The safety device of claim 1, wherein the first position activates a descending mode and the second position activates a fall arrest mode.

3. The safety device of claim 2, wherein the control is configured and arranged to be switched from the second position to the first position.

4. The safety device of claim 1, wherein the first and second brake assemblies are operatively connected.

5. The safety device of claim 1, wherein the first brake assembly includes a rotor to which at least one first pawl having a friction pad is pivotally operatively connected, the friction pad contacting the housing when the rotor rotates to decrease a rotational rate of the rotor.

6. The safety device of claim 1, wherein the second brake assembly includes a gear assembly and at least one second pawl, the at least one second pawl being operatively connected to the drum and configured and arranged to engage the gear assembly when the drum rotates at a predetermined speed.

7. The safety device of claim 1, further comprising a shaft operatively connecting the first and second brake assemblies and the control, the control locking the shaft relative to the housing in the second position thereby activating a fall arrest mode, the control allowing the shaft to rotate relative to the housing in the first position thereby activating a descending mode.

8. The safety device of claim 7, wherein the shaft includes first and second teeth.

9. The safety device of claim 8, wherein the first brake assembly includes a rotor to which at least one first pawl having a friction pad is pivotally operatively connected, the rotor including a gear, further comprising a first spur gear with inner teeth and outer teeth, the inner teeth mating with the first teeth of the shaft and the outer teeth mating with the gear of the rotor to interconnect the shaft and the rotor, the friction pad contacting the housing when the rotor rotates to decrease a rotational rate of the rotor.

10. The safety device of claim 8, wherein the second brake assembly includes a gear assembly and at least one second pawl, the gear assembly including a second spur gear mating with the second teeth of the shaft, the at least one second pawl being operatively connected to the drum and configured and arranged to engage the gear assembly when the drum rotates at a predetermined speed.

11. A safety device with fall arrest and descending modes, comprising:

a housing;

a drum rotatably operatively connected to the housing;

a lifeline having an intermediate portion interconnecting a first end and a second end, the first end being operatively connected to the drum, at least a portion of the intermediate portion being wound about the drum, the second end being operatively connected to a hook;

a first brake assembly and a second brake assembly operatively connected to the drum, the first brake assembly including a rotor to which at least one first pawl having a friction pad is pivotally operatively connected and a first spur gear, the rotor including a rotor gear, the first spur gear including inner teeth and outer teeth, the second brake assembly including a gear assembly and at least one second pawl, the gear assembly including a second spur gear;

a shaft including first and second teeth and operatively connecting the first and second brake assemblies, the inner teeth of the first spur gear mating with the first teeth of the shaft and the outer teeth mating with the rotor gear to interconnect the shaft and the rotor, the second spur gear mating with the second teeth of the shaft; and a control operatively connected to the shaft and having a first position and a second position, the first position allowing the shaft to rotate and selectively engaging the first brake assembly in a descending mode, the friction pad contacting the housing when the rotor rotates to decrease a rotational rate of the rotor, the second position locking the shaft in relation to the housing and selectively engaging the second brake assembly in a fall arrest mode, the at least one second pawl being operatively connected to the drum and configured and arranged to engage the gear assembly when the drum rotates at a predetermined speed.

12. The safety device of claim 11, wherein the control is configured and arranged to be switched from the second position to the first position.

13. A method of using a safety device having fall arrest and descending modes, the device comprising a housing, a drum rotatably operatively connected to the housing, a lifeline having an intermediate portion interconnecting a first end and a second end, the first end being operatively connected to the drum, a first brake assembly and a second brake assembly operatively connected to the drum, a shaft interconnecting the first and second brake assemblies, and a control operatively connected to the shaft and having a first position and a second position, the first position allowing the shaft to rotate and selectively engaging the first brake assembly in a descending mode, the second position locking the shaft and selectively engaging the second brake assembly in a fall arrest mode, comprising:

positioning the control in the second position thereby locking the shaft relative to a housing and activating the second brake assembly in the fall arrest mode.

14. The method of claim 13, further comprising positioning the control in the first position thereby allowing the shaft to rotate relative to the housing and activating the first brake assembly in the descending mode.

15. The method of claim 14, further comprising positioning the control in the first position thereby allowing the shaft to rotate relative to the housing and activating the first brake assembly in the descending mode after a fall has occurred.

* * * * *